US007872185B1

(12) United States Patent
Chadwick

(10) Patent No.: US 7,872,185 B1
(45) Date of Patent: Jan. 18, 2011

(54) COLLAPSIBLE STRINGED MUSICAL INSTRUMENT

(76) Inventor: Richard W. Chadwick, 607 River Ridge Ct., Nashville, TN (US) 37221

( * ) Notice: Subject to any disclaimer, the term of this patent is extended or adjusted under 35 U.S.C. 154(b) by 0 days.

(21) Appl. No.: 12/546,342

(22) Filed: Aug. 24, 2009

Related U.S. Application Data

(63) Continuation-in-part of application No. 11/873,744, filed on Oct. 17, 2007, now Pat. No. 7,696,419.

(51) Int. Cl.
*G10D 3/00* (2006.01)

(52) U.S. Cl. ..... 84/293; 84/275

(58) Field of Classification Search ..... 84/275, 84/293

See application file for complete search history.

(56) References Cited

U.S. PATENT DOCUMENTS

| | | | | | |
|---|---|---|---|---|---|
| 519,409 | A | * | 5/1894 | Middlebrooke | 84/269 |
| 2,464,100 | A | * | 3/1949 | Ruggiero | 84/275 |
| 2,803,982 | A | * | 8/1957 | Gassin et al. | 84/275 |
| 3,629,900 | A | | 12/1971 | Beerli, Jr. | |
| 4,073,211 | A | * | 2/1978 | Jorgensen | 84/291 |
| 4,132,143 | A | | 1/1979 | Stone | |
| 4,191,085 | A | * | 3/1980 | Litwin | 84/293 |
| 4,638,708 | A | * | 1/1987 | Kamal | 84/293 |
| 4,686,882 | A | | 8/1987 | Shaw | |
| 5,233,896 | A | * | 8/1993 | Worthington et al. | 84/293 |
| 5,383,385 | A | * | 1/1995 | Gilbert | 84/267 |
| 5,390,578 | A | * | 2/1995 | Raymer | 84/291 |
| 5,817,959 | A | | 10/1998 | Kagan | |
| 5,949,005 | A | * | 9/1999 | Peterson | 84/291 |
| 6,025,548 | A | * | 2/2000 | Ehrlich | 84/291 |
| 6,028,255 | A | * | 2/2000 | Myronyk | 84/293 |
| 6,037,532 | A | | 3/2000 | Beckmeir | |
| 6,353,164 | B1 | * | 3/2002 | Corsi | 84/293 |

(Continued)

OTHER PUBLICATIONS

Exhibit A—one page entitled "The Anderson Bass" from http://home.iprimus.com.au/rossjazz/Double_Bass_about.htm.

(Continued)

*Primary Examiner*—Elvin G Enad
*Assistant Examiner*—Robert W Horn
(74) *Attorney, Agent, or Firm*—Waddey & Patterson; I. C. Waddey, Jr.

(57) ABSTRACT

A collapsible acoustic stringed instrument is disclosed having a hollow body with a soundboard, a back face and a spacer defining a sound chamber. A sound post is secured within the hollow body and engaging the soundboard and the back face. The sound post has a securement pin on each end with a sharpened portion to engage the soundboard and the back face and maintain proper positioning when the instrument strings are loosened. A neck is pivotally and laterally coupled to the body, which further has a door slidably received by specially formed channels in the back face. The neck is able to pivot and slide through the door and into the sound chamber from a playing position to a stored position, without disturbing the sound post or otherwise compromising the appearance or performance of the instrument with respect to a standard non-collapsible instrument.

20 Claims, 10 Drawing Sheets

U.S. PATENT DOCUMENTS

| | | | | |
|---|---|---|---|---|
| 7,365,254 | B2 * | 4/2008 | Johansson | 84/293 |
| 7,579,535 | B2 * | 8/2009 | Pyper-Scott | 84/293 |
| 7,687,698 | B2 * | 3/2010 | Kim | 84/293 |
| 7,696,419 | B2 * | 4/2010 | Chadwick | 84/293 |
| 2001/0052281 | A1 | 12/2001 | Minakuchi | |
| 2007/0056429 | A1 * | 3/2007 | Poschelk | 84/293 |
| 2009/0151537 | A1 * | 6/2009 | Leach | 84/293 |
| 2009/0173207 | A1 * | 7/2009 | Leach | 84/293 |
| 2010/0199829 | A1 * | 8/2010 | Kamensky | 84/264 |

OTHER PUBLICATIONS

Exhibit B—one page entitled "Czech-Ease Portable Bass" from http://www.electricviolinshop.com/cw_details.cfm?ProdID-231 &category=9.

Exhibit C—one page entitled "Eminence Portable Upright Bass" from http://www.gelbass.com/bass/bass4RN.html.

Exhibit D—one page entitled "Palastino Electric Upright Bass" from http://www.palatinousa.com/Electric_Upright_Bas.392.0.html.

* cited by examiner

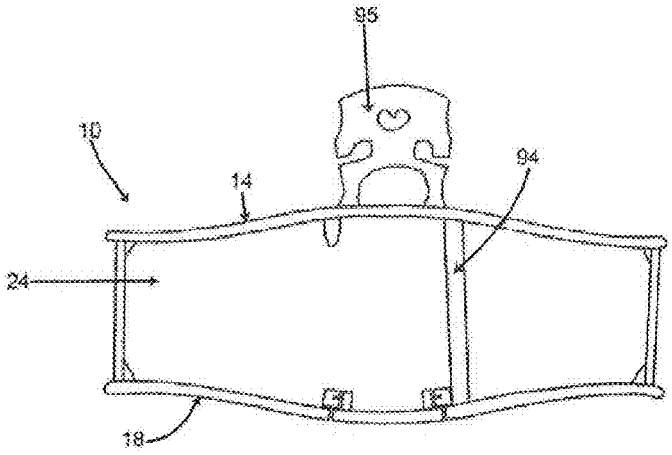
Fig. 12a
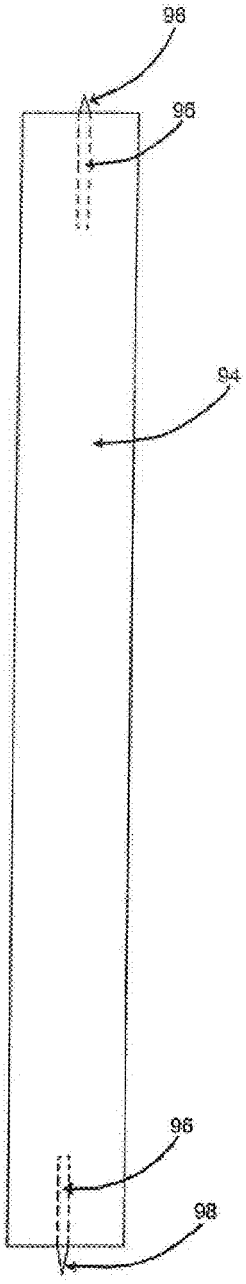
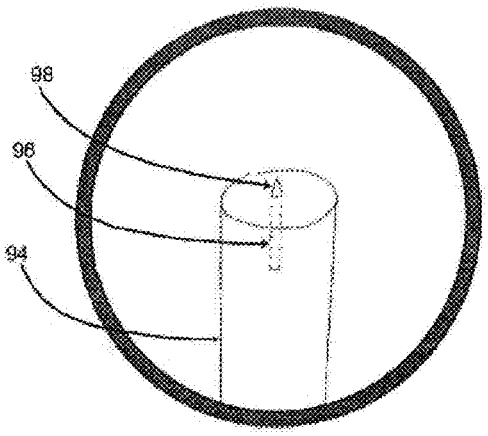
Fig. 12c
Fig. 12b

COLLAPSIBLE STRINGED MUSICAL INSTRUMENT

CROSS-REFERENCES TO RELATED APPLICATIONS

This application is a continuation-in-part of co-pending U.S. patent application Ser. No. 11/873,744 filed Oct. 17, 2007, entitled "Collapsible Stringed Musical Invention," which is hereby incorporated by reference.

BACKGROUND OF THE INVENTION

The present invention relates generally to transporting stringed musical instruments. More particularly, the present invention relates to a collapsible acoustic musical instrument.

Transporting stringed musical instruments is an endeavor with many perils. This is especially true for stringed musical instruments of the violin family such as cellos, violas, violins, and basses. Transporting an acoustic bass safely has always been particularly difficult due to its size and fragility. The top, back and sides are typically constructed of spruce and maple, usually not more than ⅜" thick. These are glued together at their edges, and a set of strings is stretched from the top to the bottom of the instrument over a thin bridge. The strings typically exert over three hundred pounds of pressure on the top of the instrument. A slight bump in the wrong place can cause the neck to snap completely off, or the bridge to crash through the top.

Transporting stringed musical instruments in hard shell cases has been previously attempted to help alleviate several of the problems associated with travel. Unfortunately, for some instruments, such as the upright bass, these hard shell cases are often too bulky to fit in cars. Moreover, air travel is no less vexatious. The hard shell cases are typically larger than the mandates, promulgated by the air lines, concerning carry-on baggage. However, even if the instrument is allowed on the airplane, whether as carry-on baggage or stored in the cargo compartment, damage to such instruments being transported in a hard shell case is distressingly common.

Another option is traveling with the musical instrument in a soft bodied bag. Although these soft travel bags may be accommodated in places the hard shell cases are not, they offer very little protection. Further, with heightened security measures at airports presently in effect, many airlines refuse to transport basses at all.

A third option is to rent an instrument at your destination. In addition to expending funds to rent an instrument, rental instruments are often of inferior quality, dissimilarly configured, and of unfamiliar setup or "feel."

Thus, what is needed is a stringed acoustical musical instrument that collapses into a completely self-contained enclosure. Allowing the instrument to collapse into a smaller form factor alleviates many of the problems discussed above.

Additionally, it would be desirable to have a collapsible instrument that securely stores all of the components removed during the collapsing process.

Furthermore, it would be expedient for the collapsible instrument to retain sound characteristics similar to those of its standard, non-collapsible counterparts.

The problematic nature of traveling with stringed musical instruments is not a conundrum that has gone unnoticed. However, no previous attempts to solve the problem have yet provided a collapsible stringed musical instrument that is travel friendly; completely self contained; preserves the rich sound characteristics of a standard, non-folding acoustic musical instrument; and transitions from a collapsed travel form into a playing configuration, and vice versa, without requiring special skills or the aid of any tools.

BRIEF SUMMARY OF THE INVENTION

The present invention is directed at a stringed musical instrument such as a double bass or cello that is conducive to traveling, completely self contained, does not sacrifice sound quality, and is easily collapsed and reassembled. In various embodiments the invention has a neck that is pivotally and laterally coupled to the body of the instrument. The body has a door that allows the neck to pivot and laterally slide through the door and into the body of the instrument. This is facilitated, in part, by lessening the tension on the strings so that the tailpiece may be removed from the body. Once the tailpiece has been removed from the body, and the tension of the strings no longer compels the neck and body to remain in an extended playing position, the neck is free to pivot and slide towards the back of the body, through the door, and store therein. The interior of the body provides fasteners adapted to receive the removed tailpiece, along with any other loose pieces, so that they may be securely stored in the body.

Because the neck is able to both pivot and slide laterally relative to the body and collapse through the door into the body, the instrument can be configured in a form factor not significantly larger than the body itself, without the aid of a recess. Any recess or other compromise to the shape of the body distorts the sound produced by the instrument, as compared to an instrument with an unaltered body. As the embodiments described eschew the pitfalls associated with providing a recess in the body, while still allowing the instrument to fold into a compact form factor, the present invention retains its true sound characteristics.

Pivotal and lateral coupling of the neck to a top portion of the body ensures proper re-positioning of the neck from a playing position to a stored position. Further, the longer throw hinge provides a more secure coupling that is critical to producing a proper acoustic sound. A short throw hinge as described in certain collapsible instruments in the prior art would produce a weak force transfer on the top of the body, which takes on greater significance with an instrument such as a bass where the amount of force exerted by a set of bass strings is about three times the force of a set of for example guitar strings. The fulcrum of the hinge of the present invention is located proximate the back face of the instrument, transferring the force down the back of the instrument and into the bottom block.

The resonant frequency of for example a bass must also be considered, in that when the neck is coupled securely to the body, the effective mass of the neck increases dramatically and the resonant frequency drops to a note outside of the musical range of the instrument. But if the neck is even slightly de-coupled, then playing a note at or near the resonant frequency of the neck will cause it to vibrate, thereby absorbing the energy of the string and producing a dead note with a hollow sound known as a "wolf tone." The pivotal and lateral coupling of the instrument is operable to provide a secure coupling and thereby a proper acoustical sound in accordance with one object of the present invention.

In preparation for travel, an embodiment directed particularly at an upright bass allows the instrument to be collapsed and any removed components to be securely stowed in the body. The invention envisions, but is not limited to, storing the tailpiece, the strings, the endpin, and the fingerboard in the body without the need for any tools. Once the instrument reaches its destination, the door may be opened allowing the neck to slide and pivot out through the door to an extended, playing position. Next, all of the stored components can be removed so that the instrument may be reassembled.

As such, the present invention discloses a stringed musical instrument that is able to collapse into a completely self contained package that facilitates traveling. Moreover, the present invention discloses an apparatus that does not adversely affect the quality of sound generated by the instrument.

BRIEF DESCRIPTION OF THE SEVERAL VIEWS OF THE DRAWINGS

FIG. 12*a* is a lateral view of the interior of an embodiment of the instrument having a sound post positioned in the sound chamber.

FIG. 12*b* is a detailed view of the sound post of FIG. 12*a*.

FIG. 12*c* is an isometric detailed view of the sound post of FIG. 12*a*.

DETAILED DESCRIPTION OF THE INVENTION

The present invention relates generally to a collapsible stringed musical instrument capable of withstanding the rigors and demands of travel. More specifically, the present invention relates to a collapsible acoustic stringed musical instrument that can be folded into a smaller form factor that eases transportation problems and protects the fragile components of the instrument. The present invention is directed at instruments of the violin family such as cellos, violas, violins, and most particularly double basses. However, those of ordinary skill in the arts will appreciate the invention is not solely limited to the instruments named above.

Figure 5:
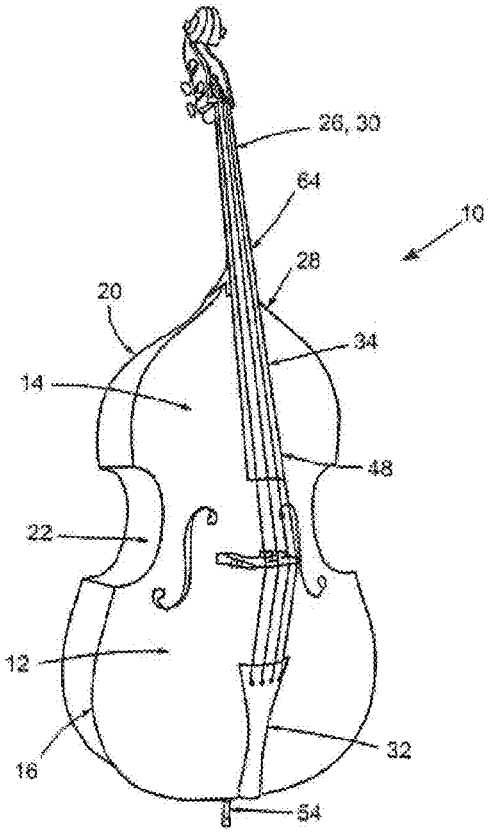
FIG. 5 is a perspective of the stringed musical instrument.

Referring now to FIG. 5, a collapsible acoustic stringed musical instrument 10 in accordance with the present invention is shown. Specifically, FIG. 5 depicts an upright bass 10. The musical instrument 10 has a body 12, also referred to as a hollow body 12 or an instrument base 12. When the musical instrument 10 is in a playing position as shown in FIG. 5, the body 12 has a soundboard 14 adjacent the plurality of strings 34. The soundboard 14 is typically a thin board whose vibrations reinforce the sound of the musical instrument 10 resulting from the movement of the plurality of strings 34 proximate the soundboard 14. The soundboard 14 is also referred to as a playing face 14 or a belly 14, in the context of an upright bass. The soundboard 14 has a first perimeter 16, or a first border 16, that defines the expanse of the soundboard 14.

Figure 6B:
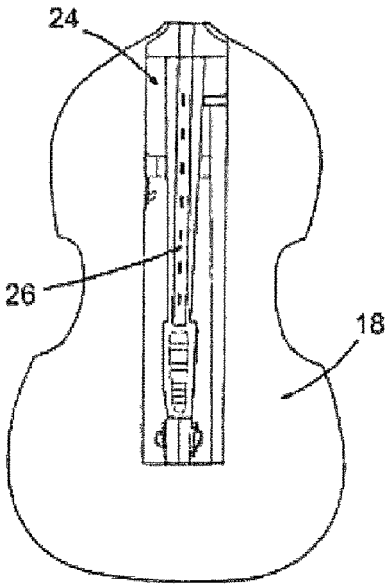
FIG. 6*b* is a rear view of the stringed musical instrument illustrating the opened door and the neck and fingerboard stored in the body of the instrument.
Figure 6C:
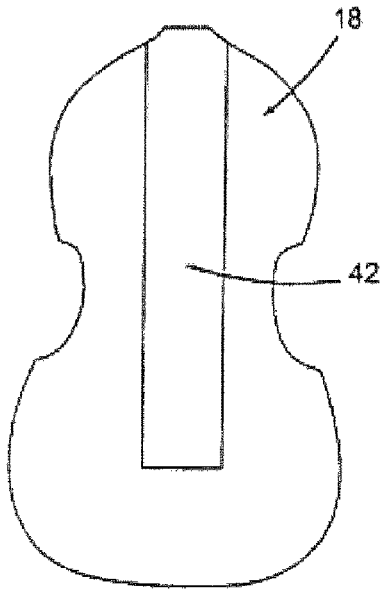
FIG. 6*c* is a rear view of the stringed musical instrument in a fully collapsed position with the door closed.
Figure 6A:
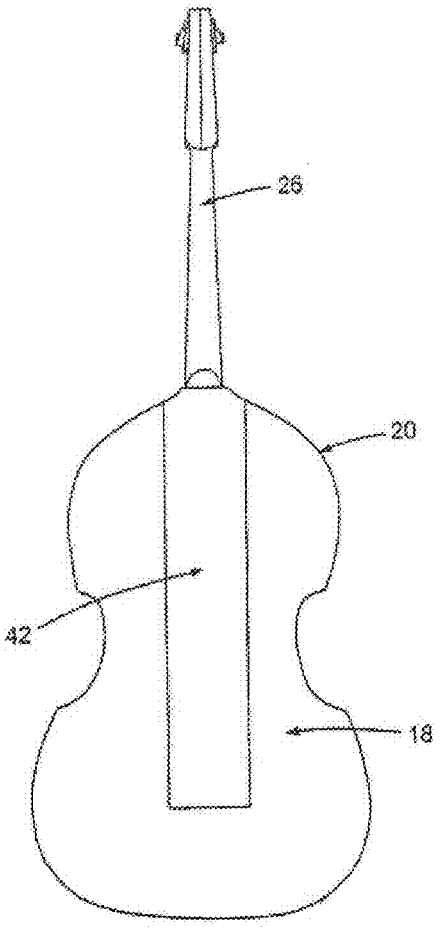
FIG. 6*a* is a rear view of the stringed musical instrument, showing the door, in an extended playing position.
Figure 7:
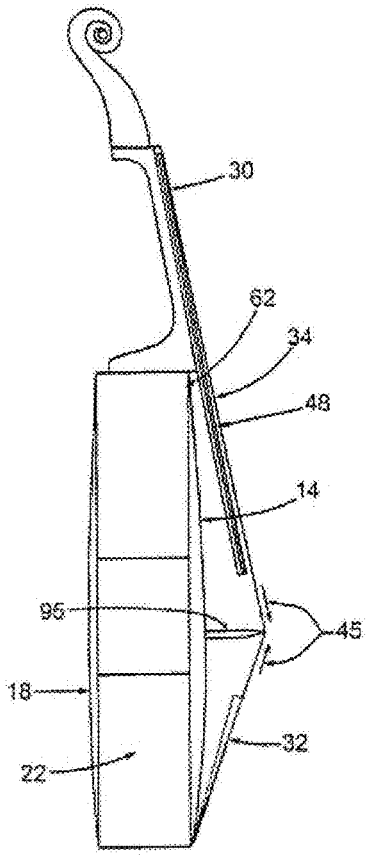
FIG. 7 is a side view showing the tensive force applied between the neck and the body.

As shown in FIGS. 6*c* and 7 the body 12 is also composed of a back face 18, also referred to as a back plate 18 or a back surface 18. The back face 18 opposes the soundboard 14. The back face 18 has a second perimeter 20, or a second border 20, that defines the expanse of the back face 18 as shown in FIGS. 5 and 6*a*. The body 12 also has a spacer 22 or periphery member 22 that extends between the first perimeter 16 of the soundboard 14 and the second perimeter 20 of the back face 18, as illustrated in FIGS. 5 and 7. FIG. 7 shows the relationship between the back face 18 and the soundboard 14 as being generally parallel from each other, as is typically seen in most acoustic stringed musical instruments. FIGS. 5 and 7 also show the spacer 22 extending between the first and second perimeters 16, 20 to form a wall or side brace.

Effectively, the spacer 22 encloses the volume between the soundboard 14 and the back face 18. Now referring to FIGS. 3 and 6*b*, the enclosed volume defined between the soundboard 14, the back face 18, and the spacer 22 defines a sound chamber 24. The sound chamber 24 is also referred to as an interior 24 or a chamber 24. The sound chamber 24 aids in projecting the resonances of the soundboard 14 caused by the vibration of the plurality of strings 34 as the strings are displaced when the instrument 10 is played.

Thus, it is readily apparent that the spatial arrangement between the soundboard 14, the back face 18, and the spacer 22, defining the sound chamber 24, has a substantial impact on the characteristics of the sound produced by the stringed instrument 10. As such, recesses or deformations in the sound chamber 24 will have an impact on the sound produced by the musical instrument 10. Resultantly, it is desirable to have an unadulterated sound chamber 24.

Referring generally to FIGS. 12*a*-12*c*, the musical instrument 10 further includes a sound post 94. Sound posts 94 as known in the art are wooden dowels that are positioned inside the sound chamber 24 of every instrument of the violin family near the point where the bridge 95 sits on the soundboard 14, the dowel at its ends engaging the soundboard 14 and the back face 18. When the strings 34 are tensioned, they push the bridge 95 against the soundboard 14 with enough force to compress it against the top of the sound post 94, thereby holding it in place. The instrument 10 can not properly be played without a sound post 94, as the vibration of the plurality of strings 34 during playing goes through the bridge 95 to the soundboard 14, and down the sound post 94 to the back face 18, so that both the soundboard 14 and the back face 18 are in tune with each other.

If the sound post 94 is fastened in any way to the body 12 with adhesive or a permanent fixture such as a nail its function may be severely compromised. Adding material to the body would alter the vibrational characteristics of the soundboard and back face, since their size and shape inherently contribute to their function, and therefore would affect the resultant sound. Further, moving the sound post 94 has very complex consequences on sound, even movement by very small amounts as little as 0.25 mm or less, and a perfect fit at both ends of the sound post 94 is critical to acquiring and maintaining desired sound quality and volume. Therefore, double basses 10 or cellos 10 that do not have a properly fitted sound post 94 intact within the body 12 will not sound like a standard instrument.

To prevent the sound post 94 from being dislodged when the strings 34 are loosened, without adding permanent material to the body of the instrument, certain embodiments of the instrument 10 as shown in FIGS. 12*b*-12*c* may further include securement pins 96 located at each end of the sound post 94. Each pin 96 is substantially located within the sound post 94, with a relatively small pointed end 98 of each pin 96 extending from the sound post 94. Each end 98 is provided to engage the soundboard 14 and the back face 18 for securement of the sound post 94 within the sound chamber 24 when the strings 34 are loosened. The pins 96 are not fixed into the plates 14, 18 but remain somewhat loose, simply maintaining contact with the plates 14, 18 and preventing the sound post 94 from falling when the string 34 tension is removed. When the strings 34 are subsequently tensioned, the plates 14, 18 again engage the ends of the sound post 94 as in a conventional post. The design of the pinned sound post 94 in this embodiment allows the sound post 94 to function in a normal manner—in an optimum position within the sound chamber, unattached to but free to vibrate against the top 14 and back plates 18 of the instrument 10.

Figure 1A:
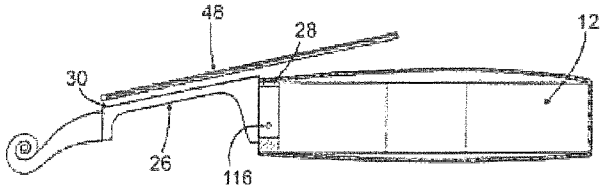
FIGS. 1*a*-1*e* are semi-transparent illustrations of the neck sliding and pivoting into the body of the stringed musical instrument.
Figure 1B:
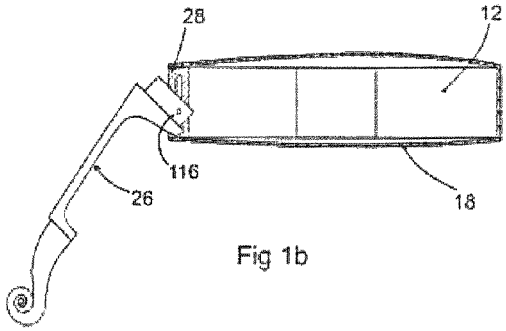
Figure 1D:
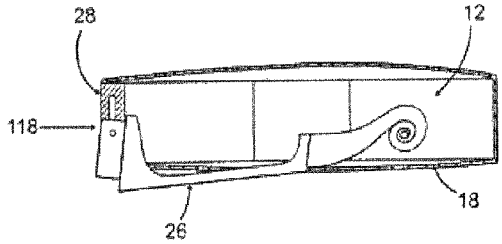
Figure 1E:
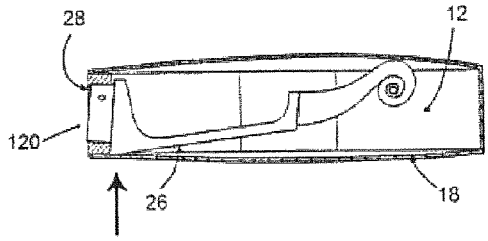
Figure 1C:
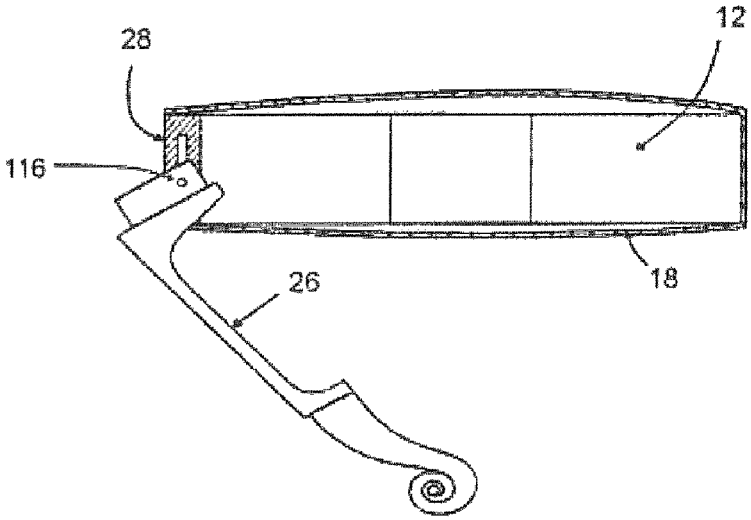
Figure 3:
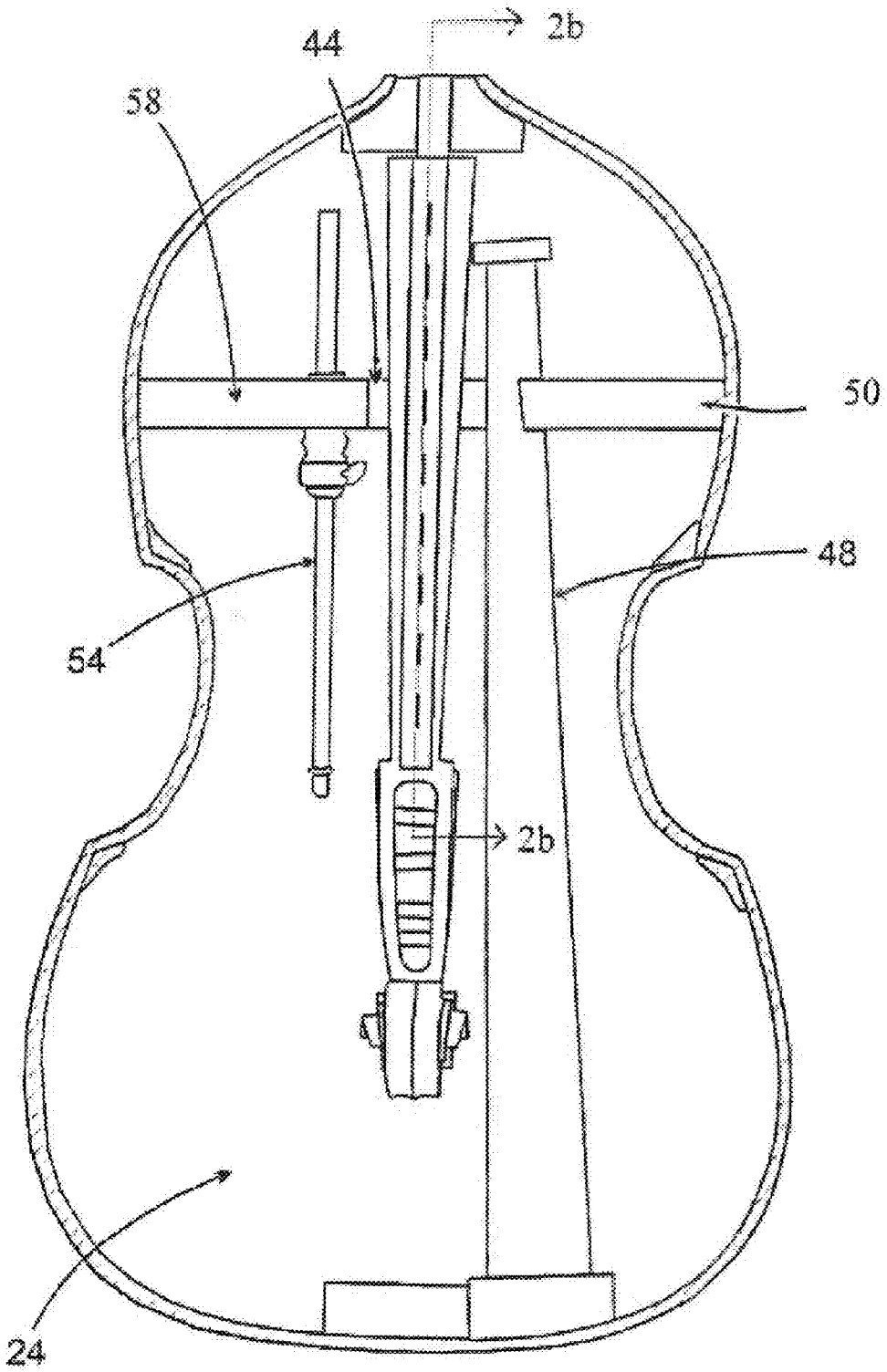
FIG. 3 is a transparent view of the rear of the stringed musical instrument depicting the fingerboard, the neck, and the endpin secured and stored within the body of the stringed musical instrument.

FIGS. 1*a*-1*e* show a cross-section of an embodiment of the instrument 10 taken at line 2*b* of FIG. 3. The stringed instrument 10 also has an elongated neck 26 that is both pivotally and laterally coupled at a bottom end of the neck 26 to a top portion of the body 28, also referred to as the near end of the body 28. Because of the pivotal and lateral coupling, the neck 26 is able to pivot about a pivot axis 116 relative to the soundboard 14. As shown in FIGS. 1*b*-1*d*, the neck 26 is able to pivot downward towards the back of the stringed musical instrument 10; namely, the back face 18. Additionally, the coupling between the neck 26 and the top portion of the body 28 allows the pivot axis 116 of the neck 26 to slide laterally, between the soundboard 14 and the back face 18 relative to the body 12.

Specifically, in various embodiments the top portion of the body 28 includes two channels 82 as described in greater detail below, but generally having a first end proximate the soundboard 14 of the instrument 10 and a second end proximate the back face 18. A bottom end of the neck 64 further includes a fixed follower 41 as described in greater detail below, generally engaging the channels 82 such that the follower 41, which further defines the pivot axis 116 of the neck 26, may laterally slide between a first position 118 and a second position 120 as shown generally in FIGS. 1*a*-1*e*. The necessary length of the channels 82 relative to the lateral width of the top portion of the body 28 varies according to the requirements for pivoting and laterally sliding the neck as defined by the physical dimensions of the neck.

More specifically, in various embodiments a method of collapsing of the instrument 10 includes at least the steps of sliding the neck 26 laterally from the second position 120 to the first position 118, pivoting the neck from an upright position parallel to a playing position as described further below to an inverted position parallel to a stored position as described further below, and then sliding the neck in the inverted position laterally from the first position 118 to the second position 120. A method in these embodiments of restoring the instrument 10 to a playing position may be carried out using the same steps in reverse order.

In various embodiments the top portion of the body 28 may instead include a fixed follower 41 and the bottom end of the neck 64 may include a channel 82. In these embodiments the bottom end of the neck 64 laterally slides between a first position 118 and a second position 120 relative to the fixed follower 41.

FIGS. 1*d*-1*e* show the neck laterally sliding. However, in an alternate embodiment, the neck 26 is only pivotally coupled to the body 12.

In an embodiment of the present invention the neck 26 may only laterally slide with respect to the body 12. This is possible because the bottom portion of the neck and the top portion of the body may be laterally coupled whether the neck is oriented in an upright or an inverted position. In such embodiments the neck 26 is when in an upright position with respect to the body 12 may be laterally slid from a playing position in various manners as described above, entirely off the back of the body 12. The neck 26 may then be manually inverted into an inverted position with respect to the body 12 by a user and slid back along the same path or channel to be stored inside the sound chamber.

The neck 26 has a front surface 30, also referred to as the anterior surface of the neck 30. The front surface of the neck 30 is proximate the plurality of strings 34 when the stringed musical instrument 10 is in a playing position as shown in FIGS. 1*a*, 5, and 7. The playing position, which may also be referred to as the first position, describes the position of the neck 26 relative to the body 12, where the neck 26 and the body 12 are in a fully extended position or in an extended collinear relationship. The playing position is analogous to the configuration of the instrument 10 that would allow a musician to play the instrument 10 in the normal course.

The stringed musical instrument 10 also has a tailpiece 32 as shown in FIG. 5. The plurality of strings 34 is stretchedly engaged between the tailpiece 32 and the front surface of the neck 30. Because the plurality of strings 34 is stretched between the tailpiece 32 and the front surface of the neck 30, it generates a tensive force 45 between the tailpiece 32 and the neck 26. The tensive force 45, depicted in FIG. 7, restricts the neck 26 from pivoting backwards towards the back face 18. In the absence of the tensive force 45, and considering the neck 26 is both slidably and pivotally connected to the body 12, the neck 26 would pivot and/or slide back towards the back face 18. The tensive force 45 may also be described as emanating from the taut engagement of the plurality of strings 34 between the front surface of the neck 30 and the tailpiece 32. As such, the tensive force 45 provides the primary motivation to keep the instrument 10 in the playing position.

In order to collapse the musical instrument 10 to a stored position, the tuning pegs (not shown) must be adjusted to remove some tension thereby allowing the tailpiece 32 to be disengaged from the soundboard 14, or the body 12 in general. Alleviating the tensive force 45 between the tailpiece 32 and the elongated neck 26 allows the neck 26 to pivot about the pivot axis 116 and slide towards the back face 18. This operation, illustrated in FIGS. 1*a*-1*e*, effectively collapses the musical instrument 10 into a stored position, or form factor more appropriate and secure for traveling.

Figure 4A:
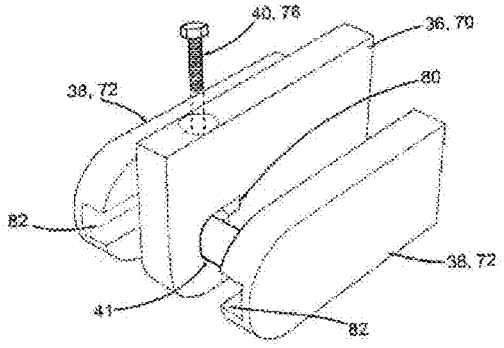
FIG. 4*a* is an exploded perspective of the connecting member allowing the neck to slide and pivot relative to the body.
Figure 4B:
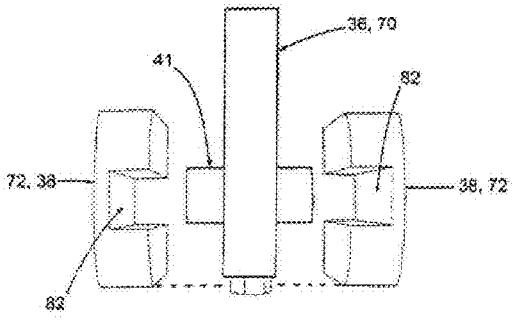
FIG. 4*b* is an exploded end view of the connecting member.
Figure 8B:
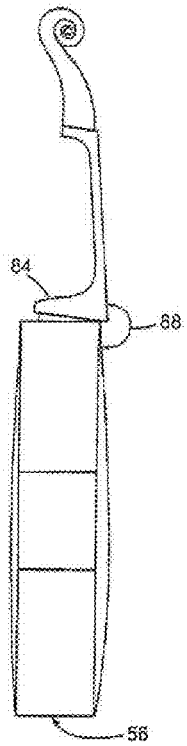
FIG. 8*b* is an exaggerated side view of the instrument showing the adjustment of the action.

As shown in FIGS. 4*a*-4*b*, the musical instrument 10 also comprises a positioner 36, or positioning member 70, engaging the neck 26 and a base member 38, or frame member 72, engaging the body 12. Furthermore, an adjustment member 40, or action setting member 76, is operably associated with the positioner 36 and the base member 38. Adjusting the adjustment member 40 exerts opposing forces on the positioner 36 and the base member 38 in a way that allows the angle 88 between the neck 26 and the body 12 to controllably change. FIG. 8*b* illustrates an exaggerated change in the angle 88 caused by an adjustment of the adjustment member 40. The relationship between the positioner 36, the base member 38, and the adjustment member 40 will be expounded upon below in terms of the frame member 72, the positioning member 70, and the action setting member 76.

The coupling between the neck 26 and the body 12 may be through a connecting member 60 which includes the positioning member 70, the frame member 72, the action setting member 76, and a guide 74 as first mentioned above and further depicted in FIGS. 4*a*-4*b*. The guide 74 may be located in either the positioning member 70 or frame member 72. In the particular embodiment illustrated in FIGS. 4*a*-4*b*, the positioning member 70 has the guide 74, although as mentioned above, the invention is not limited to this configuration. When the instrument 10 is in a playing position the guide 74 extends in a direction between the bottom end of the neck 64 and the near end of the body 28.

Figure 4C:
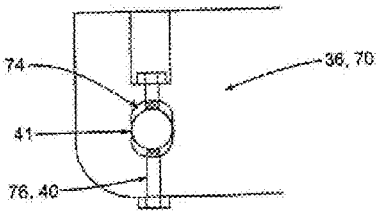
FIG. 4*c* is a side view of the connecting member.

In the embodiment illustrated in FIGS. 4*a*-4*c*, the guide 74 is an oblong slot in the positioning member 70. The action setting member 76 is operably associated with both the positioning member 70 and the frame member 72. As can be clearly seen in FIGS. 4*a*-4*b*, the follower 41 is received into the guide 74 and also engages frame member 72 through channels 82 cut into the frame member 72. The width of the follower 41 is slightly less than the width of the channels 82. By slightly less it is meant that the follower 41 may be received in the channels 82 and slide therein but without any "play" unnecessary to accomplish the aforementioned interactions. The action setting member 76, a screw in this embodiment, is associated with the frame member 72 through the follower 41. It is well appreciated that the action member could take a litany of forms. The follower 41 has a threaded bore sized to accept the action setting member 76. The guide 74 is oblong or stretched in a direction between the bottom end of the neck 64 and the near end of the body 28. The length of the guide 74 in its elongated direction is greater than the width of the follower 41. This difference 80 between the width of the follower 41 and the length of the elongated guide 74 is shown in FIG. 4*a*. The difference 80 allows the follower 41 to move in the guide 74.

Figure 4D:
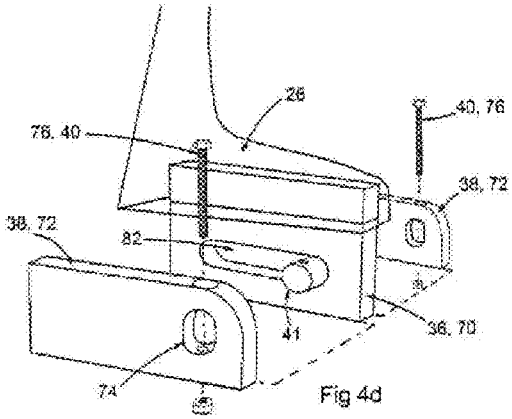
FIG. 4*d* is an exploded perspective of an alternative embodiment of the connecting member.
Figure 4E:
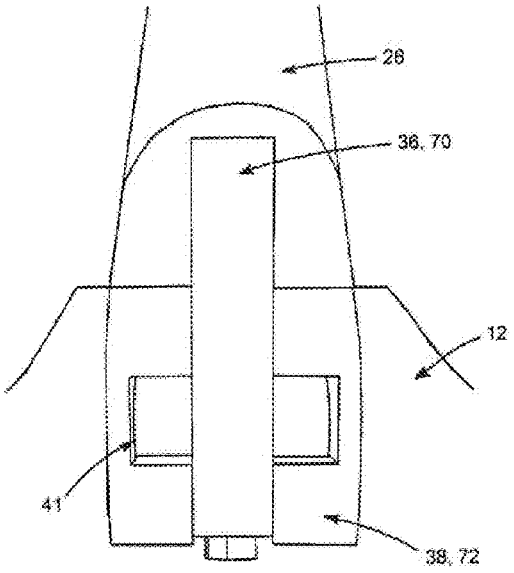
FIG. 4*e* is a front view of the connecting member allowing the neck to slide and pivot relative to the body

In an alternative embodiment shown in FIG. 4*d*, the frame member 72 has the guide 74 and the positioning member 70 contains the channel 82. The effect of the interaction between the positioning member 70, the frame member 72, the guide 74, and the follower 41 in this alternative embodiment is the same as that described above for the embodiment shown in FIGS. 4*a*-4*b*.

Figure 8A:
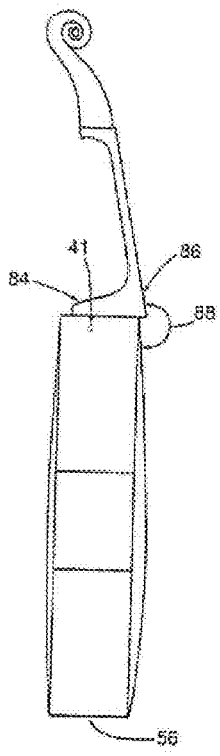
FIG. 8*a* is a side view of the instrument.

As the action setting member 76, which is received in the threaded follower 41, is adjusted, it either pulls or pushes the follower 41, depending on how the action setting member 76 is adjusted, along the elongated length of the guide 74. Because the width of the guide 74 and the channels of the frame member 72 are similar, the force imparted by adjusting the action setting member 76 can only cause the follower 41 to traverse the length of the guide 74. As the follower 41 moves along the guide 74 opposing forces are placed on the neck 26, through the positioning member 70, and the body 12, through the frame member 72. Now referring to FIGS. 8*a* and 8*b*, the movement of the follower 41 along the guide 74 exerts a force on the heel of the neck 84 either pulling the heel of the neck 84 towards the bottom end of the body 56 or away from the bottom end of the body 56. As discussed earlier the tensive force 45 holds the toe of the neck 86 firmly against the body 12. Consequently, the movement of the follower 41 along the guide 74 pivots the heel of the neck 84 relative to the toe of the neck 86 thereby causing the angle 88 between the neck 26 and the body 12 to controllably, or incrementally, change. Changing the angle 88 allows precise control of the action of the stringed musical instrument 10. As it is known to those of ordinary skill in the art, the action refers to the height of the plurality of strings 34 above the fingerboard 48.

From the preceding description it is also apparent how the neck 26 can both slide relative to the body 12 and pivot relative to the soundboard 14. Again referring to FIGS. 4*a*-4*b*, the neck 26, via the follower 41, is able to slide along the length of the channels 82 to move laterally relative to the body 12. Additionally, it is manifest that the neck 26 can pivot by virtue of its acceptance of the follower 41 in the guide 74. The positioning member 70 is free to rotate around the follower which, in turn, allows the neck 26 to rotate around the follower 41. The frame member 72 prevents the positioning member 70 from releasing the follower 41 thereby facilitating the pivoting and sliding action of the neck 26 without concern that the follower 41 will accidentally disengage from the positioning member 70.

The connecting member 60 may also have a block member 62 as shown in FIG. 7. The block member 62 restricts the neck 26 from pivoting beyond a predetermined position towards the soundboard 14 under the tensive force 45. In the preferred embodiment, the block member 62 is proximate the top portion of the body 28 and hence the soundboard 14. The block member 62 is positioned relative to the connecting member 60 and the neck 26 to prohibit the neck from hinging or pivoting forward towards the soundboard 14 by virtue of the tensive force 45. Because the plurality of strings 34 are tautly engaged between the front surface of the neck 30 and the tailpiece 32, if it were not for the block member 62, the taut engagement of the plurality of the strings 34 between the tailpiece 32 and the front surface of the neck 30 would cause the neck 26 to rotate towards the soundboard 14. Thus, the predetermined position from which the block member 62 prevents the neck 26 from pivoting beyond is analogous to the playing position.

Now referring to FIGS. 6*a*-6*c* and 9*a*-9*b*, in various embodiments the stringed musical instrument 10 may have an entryway 42 or door 42 in the back face 18 of the body 12 that provides access to the sound chamber 24. The entryway 42 is sized and positioned to receive the neck 26 in the sound chamber 24 when the neck 26 is pivoted and moved laterally relative to the body 12 into the sound chamber 24. Preferably, the entryway 42 is indiscernible from the rest of the body when the entryway 42 is in a closed position sealing the sound chamber 24. The entryway 42 may be attached to the back face 18 in a myriad of ways. For example, but not limited to, the entryway 42 may be hinged to the body 12, press fit into the body 12, or slid into the body 12 (i.e. the body 12 may be grooved to accept the entryway 42).

Figures 11A, 11B, 11C:
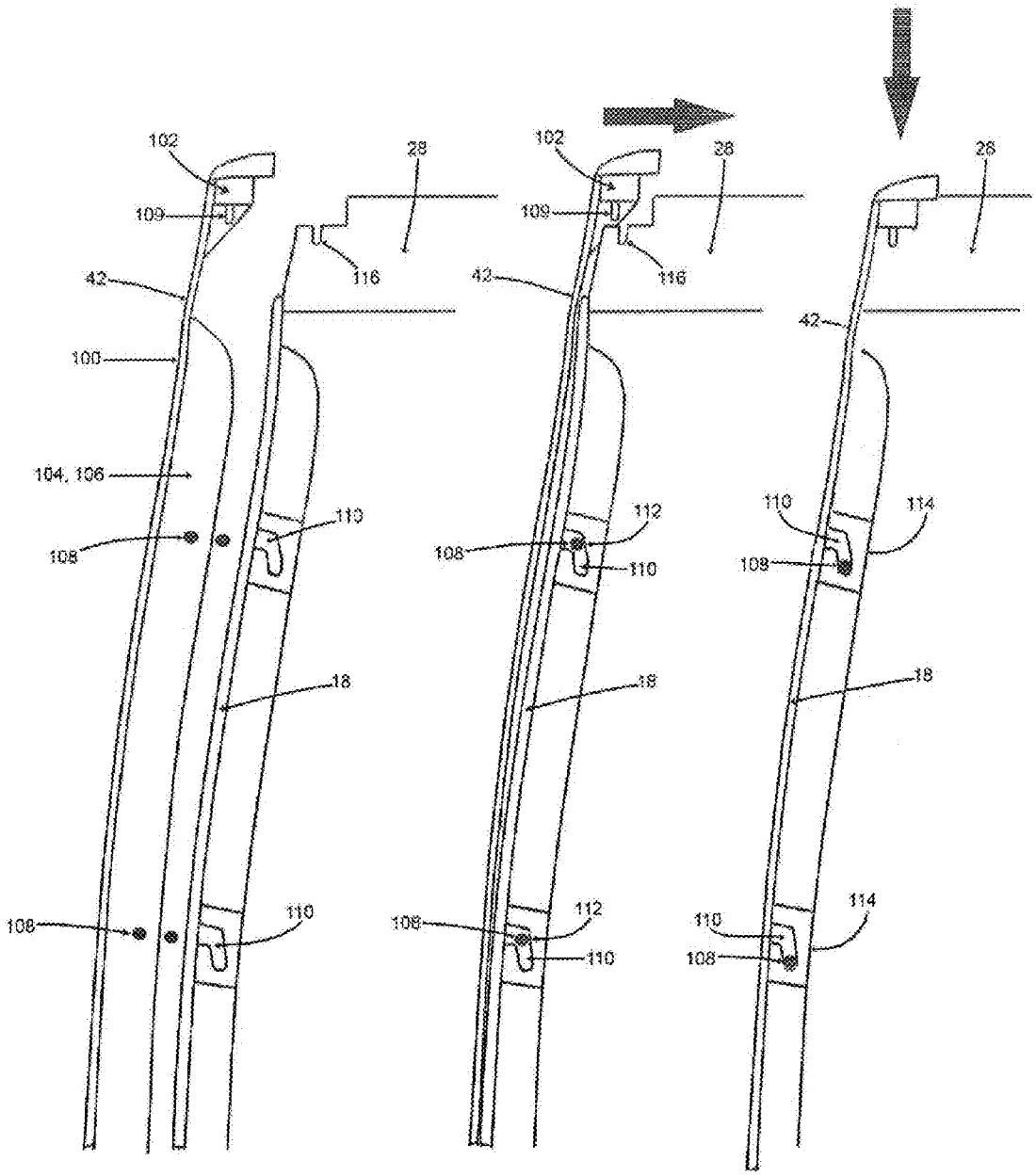
FIG. 11*a* is an exploded side view of the door locking mechanism of an embodiment of the instrument.
FIG. 11*b* is an exploded side view of the door locking mechanism of FIG. 11*a* with the door slid into a first position relative to the body of the instrument.
FIG. 11*c* is an exploded side view of the door locking mechanism of FIG. 11*a* with the door slid into a second position relative to the body of the instrument.

Referring specifically to FIGS. 11*a*-11*c*, in an embodiment of the present invention a door 42 for use with a collapsible acoustic musical instrument comprises a door locking mechanism 42 having a face 100, a top portion 102, and first and second sealing portions 104, 106 extending generally parallel to each other and perpendicular to the face 100. The sealing portions 104, 106 each have a plurality of lateral pins 108 extending generally perpendicular to the sealing portions 104, 106 and parallel to the face 100. The top portion 102 further includes at least one longitudinal pin 109 extending downward and generally parallel to the face 100.

In the embodiment shown in FIGS. 11*a*-11*c*, the back face 18 includes a plurality of slots 110 having a portion shaped to receive the lateral pins 108 of the door 42 when the door 42 is pushed in or otherwise moved laterally into a first position 112 and a portion shaped to receive to the lateral pins 108 of the door 42 when the door is subsequently pushed down or otherwise moved longitudinally from the first position 112 into a second position 114. The top portion of the body 28 has at least one notch 116 shaped to receive the at least one longitudinal pin 109 when the door is moved from the first position 112 into the second position 114.

In embodiments of the instrument 10 as shown, the back face 18 and top portion of the body 28 are shaped in cooperation with the door 42 to define a sealed perimeter such that the distinction in appearance and sound is entirely negligible and indiscernible with respect to the body of a standard instrument 10 with a non-breached back face.

Referring generally now to embodiments as shown in FIGS. 6*a*-6*c*, 9*a*-9*b* and 11*a*-11*c*, because the neck 26 is slidably and pivotedly connected to the body 12, the neck 26 is able to fluidly position itself into and store in the sound chamber 24 by passing through the entryway 42. Thus, the entryway 42 allows the instrument 10 to be folded into a stored position or form factor not disparate from that of the body 12 alone without the need to recess or otherwise deform the body 12 of the instrument 10. As discussed above, the ability of the invention to fold without the necessity of a recess engenders the instrument 10 with the ability to maintain its true sound.

As shown in FIG. 3 the musical instrument 10 may also have at least one securement member 44 or neck holder 44 positioned in the sound chamber 24 capable of restraining and storing the neck 26 after the neck 26 has been received through the entryway 42 into the second position within the sound chamber 24. The securement member 44 may be a multi-prong type press fitting, a snap fit fastener, or a sleeve. However, it will be obvious to one of ordinary skill in the arts that a multitude of fastener designs would accomplish the same end. In another preferred embodiment (not shown) the securement member 44 may be associated with the connecting member 60 and may embody a detent or hitch along range of motion of the connecting member 60 that allows the neck 26 to snap or slide into a secured, fully collapsed position. With the detent or hitch securing embodiment the neck 26 could be unfurled by firmly shifting the neck 26 out of the hitch or detent and pulling the neck 26 into a playing position.

Additionally, the entryway 42 may be further sized and positioned to accept the disengaged tailpiece 32 and the plurality of strings 34 so that they may be restrained in the sound chamber 24 by a retaining member (not shown), or a tailpiece holder, located in the sound chamber 24, which is adapted to restrain and store the tailpiece 32. As the plurality of strings 34 are coupled to the tailpiece 32, the plurality of strings 34 will also be restrained and stored inside the sound chamber 24. In one embodiment, a single retaining member will be a press fit type member. However, the present invention envisions any retaining member that may allow the tailpiece 32 to be easily restrained and removed when desired. The placement of the retaining member with one end of the plurality of strings 34 attached thereto will allow the plurality of strings 34 to naturally lie between the retaining member and the neck 26 so as to prevent the plurality of strings 34 from being damaged or otherwise kinked once they are stored in the sound chamber 24.

Figure 2A:
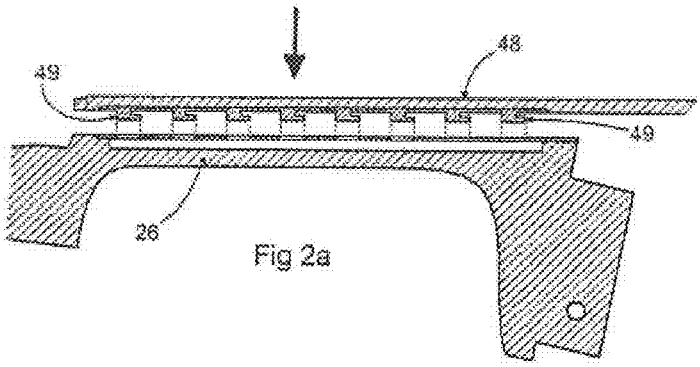
FIGS. 2*a* and 2*b* depict a cross sectional view of the fingerboard engaging the neck.
Figure 2B:
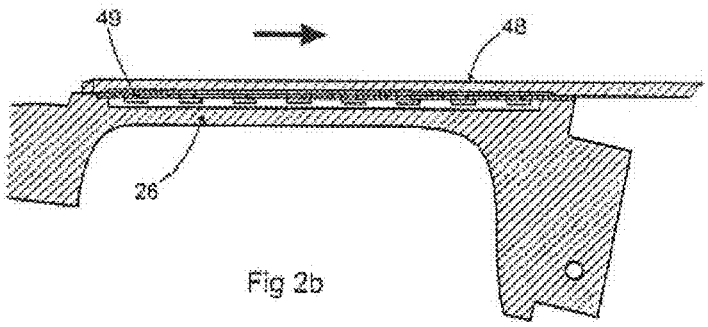
Figure 9A:
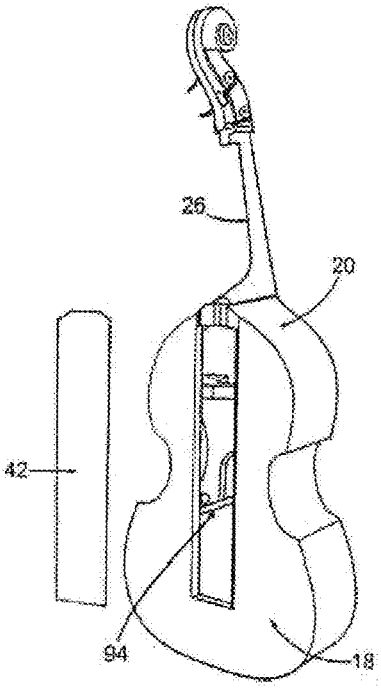
FIG. 9*a* is a perspective view of an embodiment of the instrument with the door in the open position.
Figure 9B:
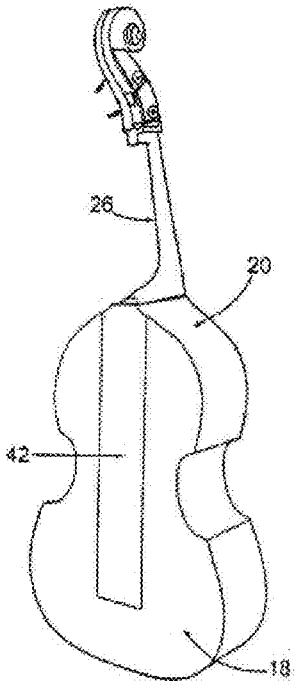
FIG. 9*b* is a perspective view of an embodiment of the instrument with the door in the closed position

The stringed musical instrument 10 may also have a fingerboard 48 demountedly coupled with the neck 26 as shown in FIGS. 2*a*-2*b* (which show a cross-section of the instrument 10 taken at line 2*b* of FIG. 3). FIG. 5 shows the fingerboard 48 extending from the neck 26 to the body 12. The fingerboard 48 as shown adds rigidity to the neck 26 as is crucial for a playable surface. However, the fingerboard 48 must be removed before the neck 26 can be collapsed into the sound chamber 24. In one preferred embodiment, shown in FIGS. 2*a*-2*b*, the fingerboard 48 has hooks 49 that may be accepted into the neck 26 which has complimentary recesses to allow the hooks 49 to slide into the neck 26 and be secured therein.

Now referring to FIG. 3, the sound chamber 24 may also have at least one fastener 50, or fingerboard holder 50, adapted to restrain and store the demountable fingerboard 48. Similarly to the retaining member, the fastener 50 may be a press fit type retainer, a sleeve, or a latch. However, the present invention envisions any fastener 50 that may allow the fingerboard 48 to be easily restrained and removed when desired.

Figure 10:
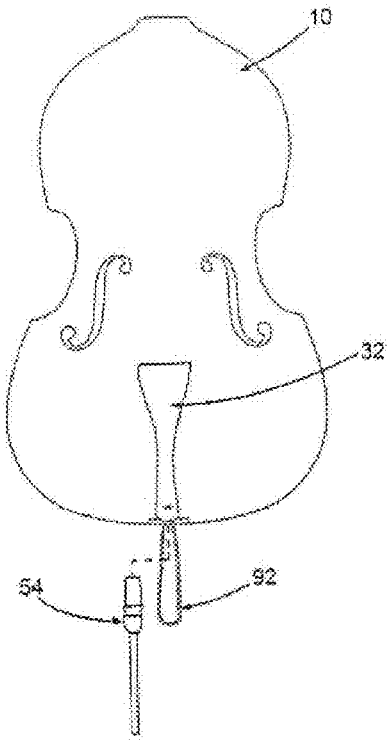
FIG. 10 is a front view of the instrument showing the relationship between the endpin, tail wire, and tailpiece.

FIG. 5 depicts an endpin 54 detachedly coupled to the bottom end of the body 56. The endpin 54 is pressed against the floor so that the instrument 10 is maintained over the floor. The endpin 54 is proximate the tailpiece 32. Preferably the endpin 54 is coupled to the body 12 by a press fit engagement. The sound chamber 24 has one endpin holder 58 that is positioned and sized to accept and secure the endpin 54 in the sound chamber 24. Preferably the endpin holder 58 is a sleeve that the endpin 54 can slide into to. However, the endpin holder may also take the form of a pronged type press fit fastener or any other fastener that allows the endpin 54 to be securely stored in the sound chamber 24. The endpin 54 may also provide an anchor to which the tailpiece 32 may be secured to the body 12 through a tail wire 92, as shown in FIG. 10. In an alternative embodiment, the tailpiece 32 is slidably engaged to the body 12. More specifically in the alternative embodiment, the tailpiece 32 would have an appendage that could be inserted into a complementary recess in the body 12 thereby securing the tailpiece 32.

As is manifest from the preceding disclosure, the features of the instrument 10 allow it to be collapsed and set up without an arduous undertaking. In fact, the process can be completed in only a matter of minutes. The expedited conversion process, from a playing position to a collapsed form or vice versa, inherent in the present invention, does not require the user to have any special knowledge or training nor does it necessitate the use of any tools. Consequently, the present invention allows even a casual user to painlessly and rapidly collapse and set up the instrument 10.

Thus, it is seen that the stringed musical instrument of the present invention readily achieves the ends and advantages mentioned as well as those inherent therein. Although certain preferred embodiments of invention have been illustrated and described for purposes of the present disclosure, numerous changes may be made by those skilled in the art which changes are encompassed within the scope and spirit of the present invention and defined by the appended claims.

What is claimed is:

1. A collapsible acoustic stringed instrument comprising:

a body comprising a soundboard having a first perimeter, a back face opposing the soundboard and having a second perimeter, a spacer extending laterally between the first perimeter and the second perimeter and defining a width of the body, wherein the spacer, the soundboard, and the back face together define a sound chamber;

a sound post positioned within the sound chamber and engaging both of the soundboard and the back face of the body; and an elongated neck having a bottom portion configured for lateral coupling to a top portion of the body, the neck in an upright position able to laterally slide approximately the width of the body from the back face to a playing position generally collinear with the soundboard, the neck in an inverted position able to laterally slide approximately the width of the body from the back face to a stored position within the sound chamber;

wherein the sound post is arranged to remain in position within the sound chamber and in engagement with the soundboard and the back face of the body throughout lateral movement of the neck.

2. The instrument of claim 1, the elongated neck further pivotally coupled to the top portion of the body, the neck able to laterally slide and pivot between the playing position and the stored position, the sound post arranged to remain in position within the sound chamber and in engagement with the soundboard and the back face of the body throughout pivotal and lateral movement of the neck.

3. The instrument of claim 2, the neck having a front surface, the instrument further comprising:

a tailpiece detachably engaged to at least a portion of the body; and a plurality of strings stretchedly engaged between the tailpiece and the front surface of the neck, wherein the stretched strings generate a tensive force between the tailpiece and the neck thereby restricting the neck from pivoting backward towards the back face.

4. The instrument of claim 3, the sound post further comprising a first pin longitudinally extending from a first end of the sound post and a second pin longitudinally extending from a second end of the sound post, the sound chamber shaped such that the back face and the soundboard receive the pins of the sound post, wherein securement of the sound post within the sound chamber is maintained when the strings are not stretchedly engaged.

5. The instrument of claim 4 further comprising:

a positioner engaging the neck;

a base member engaging the body; and an adjustment member operably associated with the positioner and the base member, wherein adjusting the adjustment member exerts opposing forces on the positioner and the base member such that the opposing force controllably changes an angle measured between the neck and the body by pivoting the neck relative to the soundboard.

6. The instrument of claim 1 further comprising:

a door in the back face of the body having an open position and a closed position, the door in the open position providing access to the sound chamber, the door sized and positioned to receive the neck in the sound chamber when the neck is inverted and moved laterally relative to the body; and a securement member positioned in the sound chamber and adapted to restrain and store the neck when the neck is in the stored position.

7. The instrument of claim 6 further comprising:

a tailpiece detachably engaged to at least a portion of the body; and a plurality of strings extending between the tailpiece and the neck, wherein the entryway is further sized and positioned to accept the tailpiece and the plurality of strings and the sound chamber has at least one retaining member adapted to restrain and store the tailpiece.

8. A foldable acoustic stringed musical instrument comprising:

a hollow body having a playing face, a back plate, and a sound post positioned within an interior of the hollow body and engaging the playing face and the back plate;

a door in the back plate having a face, a top portion, and first and second sealing portions extending perpendicular to the face, the door further comprising a plurality of lateral pins extending from the first and the second sealing portions, a plurality of longitudinal pins extending from the top portion;

the back plate further having a plurality of slots, the slots having a first portion shaped to slidably receive the lateral pins of the door in a first position and a second portion shaped to slidably receive the lateral pins of the door in a second position;

a top portion of the body having a plurality of notches shaped to slidably receive the longitudinal pins when the door travels from the first position into the second position; and a neck pivotally and slidably engaging the top portion of the body, the door sized and positioned so that when the door is opened the neck may pivot and slide between a first position extending generally collinear with the playing face and a second position in the interior of the body.

9. The instrument of claim 8, the door in the second position in combination with the back plate and the top portion of the body comprising a sealed outer surface of the body preventing ingress to the interior.

10. The instrument of claim 8 further comprising:

a tailpiece removably connected to the body; and a plurality of strings distended between the tailpiece and the neck, wherein the distended plurality of strings provide a force that prevents the neck from rotating backward towards the back plate.

11. The foldable stringed musical instrument of claim 10, wherein the interior of the body has at least one retaining member positioned and sized to securely hold the tailpiece in the interior.

12. The foldable stringed musical instrument of claim 11 further comprising:

a fingerboard slidably engaging the neck so that the fingerboard may be removed from the neck, and wherein the interior of the body has at least one fingerboard holder positioned and sized to secure the fingerboard in the interior.

13. The foldable stringed musical instrument of claim 12 further comprising:

an endpin detachably coupled to a bottom portion of the body, wherein the interior of the body has at least one endpin holder positioned and sized to secure the endpin in the interior.

14. A collapsible stringed musical instrument comprising:

a hollow instrument base having first and second ends defining a length, the base further comprising a belly, a back surface opposing the belly, a chamber disposed between the belly and the back surface, a sound post secured in the chamber and engaging the belly and the back surface, and a door slidably received by the back surface, wherein the door in an opened position allows ingress into the chamber and the sound post remains in engagement with the belly and back surface when the door is in said open position;

an elongated neck comprising an anterior surface; and a connecting member comprising a block member pivotally joining a bottom end of the elongated neck to the first end of the instrument base, the pivotal joint defining a pivot axis parallel to the plane of the belly, the pivot axis adjustable by a user to slide transverse the length of the base and approximately the entire width of the first end of the base, the connecting member further adapted to allow the neck to slide and pivot between a playing position, defined by the anterior surface of the neck and the instrument base in an extended collinear relationship, and a stored position wherein the neck is entirely within the chamber, and wherein the block member restricts the neck from pivoting beyond a predetermined position towards the belly.

15. The instrument of claim 14, further comprising a tailpiece detachably engaging at least a portion of the belly; and a plurality of strings tautly engaged between the anterior surface of the neck and the tailpiece so that the taut engagement of the plurality of strings to the neck and the tailpiece restricts the neck from pivoting backward towards the back surface of the instrument base, the detachable engagement of the tailpiece to the belly allowing the neck to pivot and slide from the playing position to the stored position.

16. The collapsible stringed musical instrument of claim 15, the sound post further having opposing ends, a securement pin longitudinally disposed at each end with a sharpened portion of each pin extending to engage the belly and the back surface, wherein the sound post remains in engagement with the belly and the back surface when the tailpiece is detached.

17. The collapsible stringed musical instrument of claim 15 further including a neck holder, located and dimensioned to secure the neck as the neck slides and pivots through the door and into the chamber; and a tailpiece holder located and sized to receive and secure the detachable tailpiece in the chamber.

18. The collapsible stringed musical instrument of claim 15 further comprising:

a fingerboard slidably coupled to the neck, and further including a fingerboard holder located and sized to receive and secure the fingerboard in the chamber.

19. The collapsible stringed musical instrument of claim 15 further comprising:

an endpin detachably coupled to a bottom portion of the instrument base, and an endpin holder located and sized to receive and secure the endpin in the chamber.

20. The collapsible stringed musical instrument of claim 15, wherein the connecting member further comprises:

a positioning member engaging the neck;

a frame member engaging the instrument base, wherein one of the positioning and the frame members has a guide and the other of the positioning and frame members is operably associated with the guide, and wherein the guide extends in a direction between the bottom end of the elongated neck and the near end of the instrument base; and an action setting member operably associated with the positioning member and the frame member, wherein manipulating the action setting member causes the one of the positioning and the frame members operably associated with the guide to follow the guide resulting in the bottom end of the neck incrementally moving relative to the instrument base.

* * * * *